US010519706B2

(12) United States Patent
Ikeda et al.

(10) Patent No.: US 10,519,706 B2
(45) Date of Patent: Dec. 31, 2019

(54) VEHICLE WINDOW GLASS LIFTING DEVICE AND VEHICLE

(71) Applicant: MITSUBA Corporation, Gunma (JP)

(72) Inventors: Hiroyuki Ikeda, Nagano (JP); Hideaki Takehara, Nagano (JP); Yasuhiro Saito, Nagano (JP); Sadaji Umehara, Nagano (JP); Tsuyoshi Kondo, Nagano (JP); Masakane Yoshizawa, Nagano (JP); Hideaki Kashiwagi, Nagano (JP); Mayu Kobayashi, Nagano (JP)

(73) Assignee: MITSUBA CORPORATION, Gunma (JP)

( * ) Notice: Subject to any disclaimer, the term of this patent is extended or adjusted under 35 U.S.C. 154(b) by 77 days.

(21) Appl. No.: 15/736,573

(22) PCT Filed: Jul. 10, 2015

(86) PCT No.: PCT/JP2015/069856
§ 371 (c)(1),
(2) Date: Dec. 14, 2017

(87) PCT Pub. No.: WO2016/208085
PCT Pub. Date: Dec. 29, 2016

(65) Prior Publication Data

US 2018/0142510 A1 May 24, 2018

(30) Foreign Application Priority Data

Jun. 25, 2015 (JP) ..... 2015-127854

(51) Int. Cl.
*E05F 15/43* (2015.01)
*E05F 15/689* (2015.01)
*E05F 15/73* (2015.01)

(52) U.S. Cl.
CPC ..... *E05F 15/431* (2015.01); *E05F 15/689* (2015.01); *E05F 15/73* (2015.01);
(Continued)

(58) Field of Classification Search
None
See application file for complete search history.

(56) References Cited

U.S. PATENT DOCUMENTS 5,955,854 A * 9/1999 Zhang ..... B60J 7/0573 318/264
6,925,755 B1 * 8/2005 Kyrtsos ..... G01S 13/04 49/26

(Continued)

FOREIGN PATENT DOCUMENTS

JP H11006361 A 1/1999
JP 2002227521 A 8/2002
JP 2007186915 A 7/2007

OTHER PUBLICATIONS

International Search Report dated Sep. 8, 2015 issued in PCT/JP2015/069856.

(Continued)

*Primary Examiner* — Catherine A Kelly
(74) *Attorney, Agent, or Firm* — Scully, Scott, Murphy & Presser, P.C.

(57) ABSTRACT

A vehicle window glass lifting device includes a drive mechanism arranged on a vehicle door to vertically move a window glass, a control unit for controlling the drive mechanism, and a camera for capturing an image of a detection line provided on a vehicle interior side of the window glass, the detection line being along at least a part of an outer edge of the window glass in a state that the door and the window glass are closed. The control unit includes a detection means to detect a blocked state in which at least a part of the detection line is blocked by a foreign object, and a pinching (Continued)

prevention means that causes the drive mechanism to conduct a pinch prevention operation for preventing pinching by the window glass when the blocked state is detected by the detection means while the window glass is moved by the drive mechanism.

16 Claims, 10 Drawing Sheets

(52) U.S. Cl.
CPC ... *E05F 2015/435* (2015.01); *E05F 2015/767* (2015.01); *E05Y 2900/55* (2013.01)

(56) References Cited

U.S. PATENT DOCUMENTS 6,984,818 B1 * 1/2006 Breed ..... G01S 17/026 250/221
7,030,907 B2 * 4/2006 Nagao ..... B60Q 1/2665 348/164
7,067,794 B2 * 6/2006 Le Gallo ..... E05F 15/431 250/221
7,436,136 B2 * 10/2008 Rhodes ..... E05F 15/431 318/280
2005/0174079 A1 * 8/2005 Mersch ..... B60J 7/0573 318/280
2005/0276449 A1 * 12/2005 Pedemas ..... E05F 15/431 382/104
2008/0074067 A1 * 3/2008 Rhodes ..... E05F 15/431 318/280
2008/0094471 A1 * 4/2008 Usami ..... B60R 1/00 348/148
2014/0373446 A1 * 12/2014 Weidenbacher ..... E05F 15/695 49/31
2018/0044964 A1 * 2/2018 Ikeda ..... B60J 1/00
2018/0058127 A1 * 3/2018 Ikeda ..... B60J 1/00
2018/0100342 A1 * 4/2018 Ikeda ..... B60J 1/00
2018/0142510 A1 * 5/2018 Ikeda ..... E05F 15/689
2018/0187472 A1 * 7/2018 Ikeda ..... E05F 15/40
2018/0328095 A1 * 11/2018 Kobayashi ..... B60J 1/00
2019/0003232 A1 * 1/2019 Kobayashi ..... B60J 1/00

OTHER PUBLICATIONS

International Preliminary Report on Patentability dated Jan. 4, 2018 issued in PCT/JP2015/069856.
Extended European Search Report dated Feb. 4, 2019 from related EP 15896403.1.

* cited by examiner

VEHICLE WINDOW GLASS LIFTING DEVICE AND VEHICLE

TECHNICAL FIELD

The present invention relates to a vehicle window glass lifting device and a vehicle.

BACKGROUND ART

In recent years, vehicle window glass lifting devices for automatically raising or lowering window glasses are mounted on vehicles so that windows can be easily opened or closed.

Vehicle window glass lifting devices are provided with a drive mechanism arranged at a vehicle door for moving a window glass vertically and a control unit for controlling the drive mechanism.

Since the window glasses are electrically raised or lowered, the vehicle window glass lifting devices are generally provided with a mechanism to prevent pinching by window glass.

It is known that one of such mechanism is configured to monitor variation in rotational speed of a motor which drives a window glass, to determine that a foreign object is pinched by the window glass when a load increases and the rotational speed of the motor is reduced during raising the window glass, and to conduct various safety operations such as automatic lowering of window glass by reversing its movement direction.

In such a mechanism, however, the safety operations are conducted after a foreign object (part of human body, etc.) is actually caught. Therefore, a load is inevitably applied to human body and this causes a safety problem. For example, in this mechanism, since a region of, e.g., 4 mm from the closing end for the window glass is often configured as an insensitive zone so that full closing of the window glass is not incorrectly detected as occurrence of pinching, the safety operation may not be conducted when, e.g., a finger of a young child is trapped, hence, improvement is desired.

The vehicle window glass lifting device disclosed in PTL 1 solved such problems.

In PTL 1, it is described that a camera is located on the vehicle interior side with respect to the window glass as well as on the lower-front side of the vehicle with respect to the window glass, a foreign object to be possibly pinched by the window glass is detected based on an image captured by the camera, and various safety operations such as automatic lowering of window glass is conducted.

In PTL 1, it is also described that a marking applied around a window frame or an edge of the outline of the window frame, etc., is used as a feature amount for foreign object determination, and various safety operations are conducted when a foreign object is present between the markers, etc., used as a feature amount and the camera.

The detection of the foreign object to be possibly pinched by the window glass based on the image captured by the camera as described in PTL 1 allows a safety operation to be conducted before the object is pinched, and safety is thereby further improved.

CITATION LIST

Patent Literature

PTL 1: JP 2007/186915 A

SUMMARY OF INVENTION

Technical Problem

In a vehicle, a part of the passenger's body is located close to the window glass, i.e., located between the camera and the marker, etc., even in normal use depending on the position of the seat, the physical size of the passenger, or the position of the passenger (e.g., the case that the passenger reclines to the door etc.), and this causes a safety operation such as automatic lowering of window glass or halt of window glass movement to be conducted during raising the window glass even though there is actually no possibility of getting pinched by the window glass. There is also a case where the window glass cannot be raised or lowered even though the lifting operation is intended. In such a case, it is not possible to close or move the window even when a user wants to close or move the window in normal use, causing inconvenience.

To improve convenience, the camera and the marker, etc., could be provided very close to the window glass. In this case, however, a foreign object cannot be detected unless the foreign object advances very close to the window glass. Therefore, the safety operation conducted after detection of the foreign object may be too late to halt the window glass, resulting in that the foreign object gets pinched by the window glass and safety decreases. Particularly in a vehicle with a small door trim width or small sash width, the position of the camera or marker, etc., is close to the window glass and sufficient safety may not be ensured.

Furthermore, it is considered that the passenger's head comes close to a relatively upper region of the window glass when the passenger reclines to the door. Sufficient safety is necessary to be ensured since pinching by the window glass is likely to occur in the upper region of the window glass. Meanwhile, achieving both safety and convenience is desired by available to move the window glass when pinching by the window glass is not possibly in the case that the passenger reclines to the door described above.

It is an object of the invention to provide a vehicle window glass lifting device that makes it possible to improve convenience while maintaining safety, and a vehicle.

Solution to Problem

A vehicle window glass lifting device according to one embodiment of the present invention comprises:

- a drive mechanism arranged on a vehicle door to vertically move a window glass;
- a control unit for controlling the drive mechanism; and
- a camera for capturing an image of a detection line provided on the vehicle interior side of the window glass, the detection line being along at least a part of an outer edge of the window glass in a state that the door and the window glass are closed,
- wherein the control unit comprises a detection means to detect a blocked state in which at least a part of the detection line captured as the image by the camera is blocked by a foreign object, and a pinching prevention means that causes the drive mechanism to conduct a pinch prevention operation for preventing pinching by the window glass when the blocked state is detected by the detection means while the window glass is moved by the drive mechanism,
- wherein the detection line comprises at least a first detection line, and a second detection line provided closer to the window glass in a vehicle width direction than the first detection line, wherein the detection means is configured to detect at least a first blocked state in which at least a part of the first detection line is blocked by the foreign object and a second blocked state in which at least a part of the second detection line is blocked by the foreign object, wherein the pinching prevention means is configured to, while the window glass is moved, cause the drive mechanism to conduct a control to reduce an operational speed of the window glass when the first blocked state is detected, and cause the drive mechanism to conduct the pinch prevention operation when the second blocked state is detected.

The above embodiment of the present invention comprises a configuration that "wherein the detection line comprises at least a first detection line, and a second detection line provided closer to the window glass in a vehicle width direction than the first detection line, wherein the detection means is configured to detect at least a first blocked state in which the first detection line is at least partially blocked by the foreign object and a second blocked state in which the second detection line is at least partially blocked by the foreign object, wherein the pinching prevention means is configured to, while the window glass is moved, cause the drive mechanism to conduct a control to reduce an operational speed of the window glass if the first blocked state is detected, and cause the drive mechanism to conduct the pinch prevention operation if the second blocked state is detected".

Thus, the second detection line that is a reference line for conducting the pinching prevention operation can be provide on a position closer to the window glass. It is possible to prevent a problem such that the pinch prevention operation is conducted despite no risk of getting pinched by the window glass and the window glass cannot be moved even when intended to move, hence, convenience is improved.

As a result, although the passenger reclines door, the window glass can be moved even when there is no risk of getting pinched by the window glass, hence, safety and convenience can be ensured.

A vehicle according to another embodiment of the invention comprises the vehicle window glass lifting device according to the above embodiment.

Advantageous Effects of Invention

According to the present invention, it is possible to provide a vehicle window glass lifting device that makes it possible to improve convenience while maintaining safety, and a vehicle.

DESCRIPTION OF EMBODIMENTS

Embodiment

Figure 1:
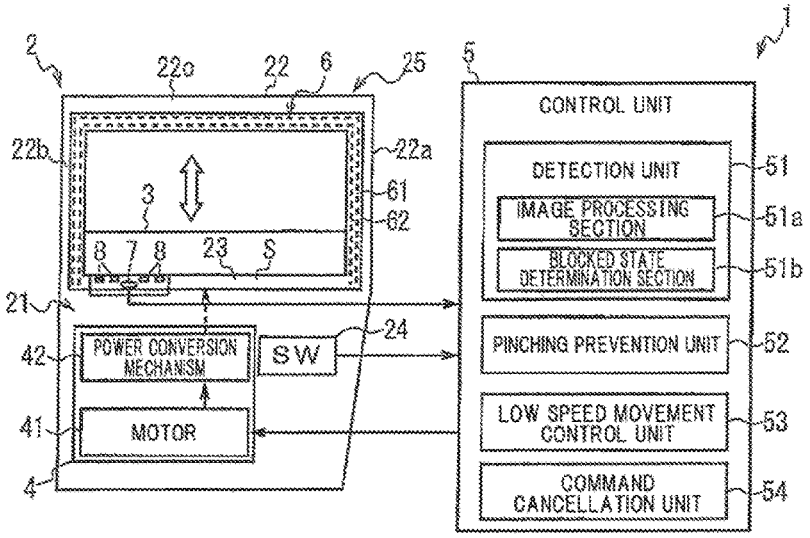
FIG. 1 is an explanatory diagram illustrating a vehicle window glass lifting device in an embodiment of the present invention.

An embodiment of the invention will be described below in reference to the drawings FIG. 1 is an explanatory diagram illustrating a vehicle window glass lifting device in the present embodiment.

As shown in FIG. 1, a door 2 of a vehicle (vehicle door) mounting a vehicle window glass lifting device 1 has a storage portion 21 for housing a window glass 3 and a frame portion 22 provided above the storage portion 21. A door trim 23 is attached on the vehicle interior side of the storage portion 21 so as to cover the storage portion 21.

The frame portion 22 is composed of a rear upright portion 22*a* extending upwards from an end of the storage portion 21 on the rear side in the front-back direction of the vehicle, a front upright portion 22*b* extending upwards from the storage portion 21 on the front side with respect to the rear upright portion 22*a*, and an upper extended portion 22*c* extending from the top end of the rear upright portion 22*a* to the top end of the front upright portion 22*b*. When the window glass 3 is fully closed, the window glass 3 is positioned in a space surrounded by the frame portion 22 and the upper edge portion of the door trim 23. That is, a window frame 25 is composed of the frame portion 22 and the upper edge portion of the door trim 23. In the present embodiment, the window frame 25 means a portion contacting an outer edge of the window glass 3 in a state that the door 2 and the window glass 3 are closed.

The vehicle window glass lifting device 1 is provided with a drive mechanism 4 for driving the window glass 3 and a control unit 5 for controlling the drive mechanism 4.

The drive mechanism 4 is to move the window glass 3 vertically relative to the window frame 25, and is provided with a motor 41 such as DC motor and a power conversion mechanism 42 for converting a drive force of the motor 41 into power to vertically move the window glass 3. The power conversion mechanism 42 which can be used here is, e.g., a window regulator which is provided with a carrier plate supporting the window glass 3 and slidably moving along a guide rail and is configured to slidably move a wire along the guide rail by a drive force of the motor 41 and thereby to vertically move the carrier plate attached to the wire and the window glass 3 along the guide rail. An X-Arm type or another type of regulator can be also used as the power conversion mechanism 42.

A switch (SW) 24 is provided on the door 2 to lift the window glass 3. An output signal line of the switch 24 is connected to the control unit 5. The switch 24 is constructed from, e.g., a two-stage click-type rocker switch which is configured to output a signal to the control unit 5, such that a first-level move-down click signal is output when an end on the move-down side is clicked to the first level, a second-level move-down click signal is output when the end on the move-down side is clicked to the second level, a first-level move-up click signal is output when the other end on the move-up side is clicked to the first level, and a second-level move-up click signal is output when the other end on the move-up side is clicked to the second level.

The control unit 5 controls the drive mechanism 4 according to the signal from the switch 24 to vertically move the window glass 3. The control unit 5, as a control unit constructed by appropriately combining CPU, memory, interface and software, etc., is mounted on the door 2. Other than on the door 2, the control unit 5 may alternatively be mounted as a part of, e.g., an electronic control unit (ECU) which controls mirrors or seats of the vehicle.

The control unit 5 is configured to control the drive mechanism 4 such that when a first-level move-down click signal is input from the switch 24, the window glass 3 is lowered while the signal is being input, and when a second-level move-down click signal is input, the window glass 3 continues to move down until the window glass 3 reaches the bottom or the switch 24 is operated again. Also, the control unit 5 controls the drive mechanism 4 such that when a first-level move-up click signal is input from the switch 24, the window glass 3 is raised while the signal is being input, and when a second-level move-up click signal is input, the window glass 3 continues to move up until the window glass 3 reaches the top or the switch 24 is operated again.

Next, a configuration to prevent pinching by the window glass 3 will be described.

The vehicle window glass lifting device 1 is provided with a camera 7 which captures an image of a detection line 6. The detection line 6 is provided on the vehicle interior side with respect to the window glass 3 and is at least partially along the outer edge of the window glass 3 in a state that the door 2 and the window glass 3 are closed. In the present embodiment, whether or not a foreign object to be possibly pinched by the window glass 3 is present is judged based on an image captured by the camera 7. A specific configuration and installed position of the camera 7 will be described later.

The detection line 6 is a reference line for judging presence/absence of a foreign object to be possibly pinched by the window glass 3, and is provided on the vehicle interior side with respect to the window glass 3. A specific configuration and setting position of the detection line 6 will be described later.

In the present embodiment, light sources 8 emitting infrared radiation toward the detection line 6 are also provided. The camera 7 is constructed from an infrared camera which captures the infrared radiation emitted from the light sources 8 and reflected by the detection line 6. Since the light sources 8 are provided, a foreign object to be possibly pinched can be detected also during the night, or in a dark place even in a daytime where infrared radiation does not reach, e.g., in an underground parking, etc. A light source which emits near infrared radiation can be used as the light source 8.

The control unit 5 has a detection unit 51 and a pinching prevention unit 52. The detection unit 51, which is one aspect of the detection means of the invention, detects a blocked state in which the detection line 6 captured by the camera 7 is at least partially blocked by a foreign object. The pinching prevention unit 52, which is one aspect of the pinching prevention means of the invention, causes the drive mechanism 4 to conduct a pinch prevention operation for preventing pinching by the window glass 3 when the blocked state is detected by the detection unit 51 while the window glass 3 is moved by the drive mechanism 4. Specific control contents of the detection unit 51 and the pinching prevention unit 52 will be described later.

Next, specific configurations, etc., of the camera 7 and the detection line 6 will be described.

Figure 2:
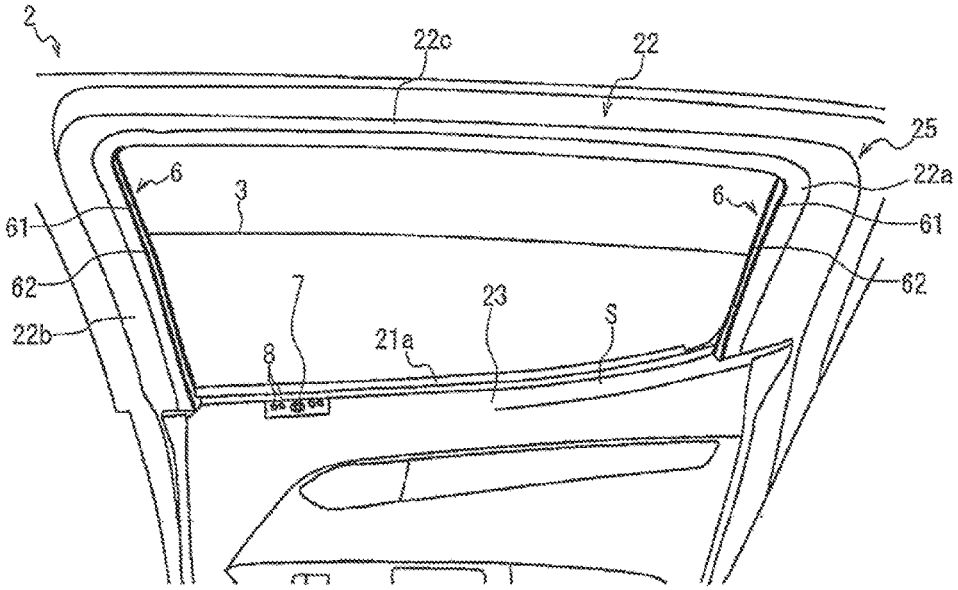
FIG. 2 is an explanatory diagram illustrating a door when viewed from the upper side inside a vehicle.
Figure 3:
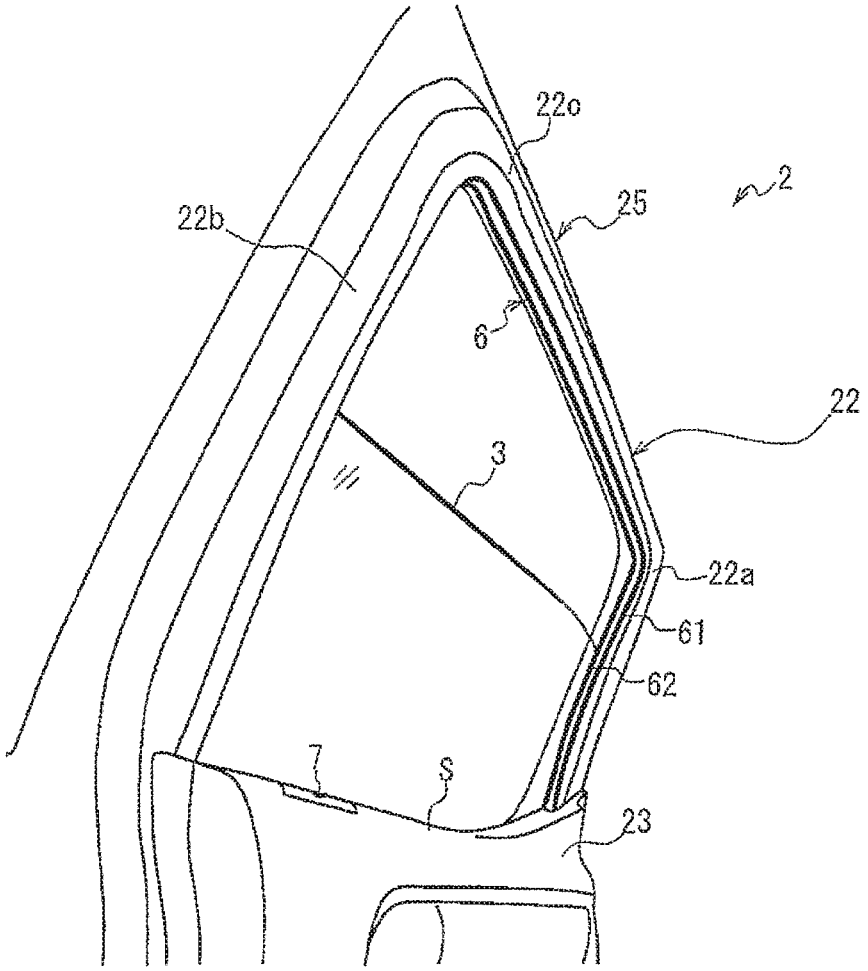
FIG. 3 is an explanatory diagram illustrating the door when viewed from the lower-front side of the vehicle.
Figure 4A:
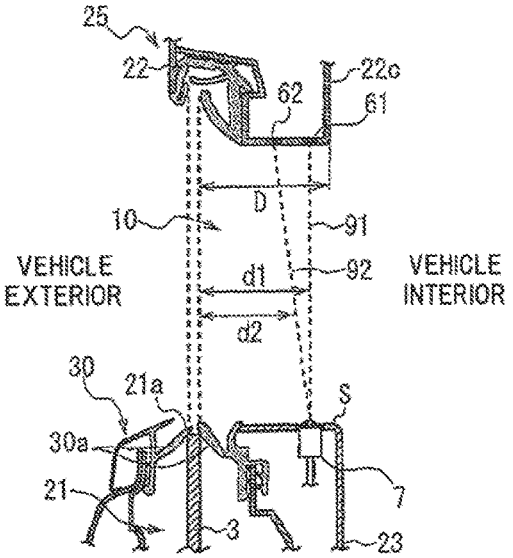
FIG. 4A is a cross sectional view illustrating a cross section in a vertical direction of the door at the position including a camera.
Figure 4B:
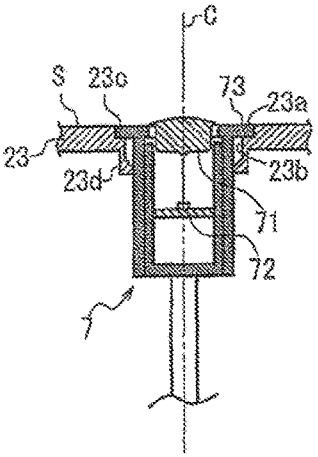
FIG. 4B is an enlarged view of FIG. 4A showing the position provided with the camera.

FIG. 2 is an explanatory diagram illustrating the door 2 when viewed from the upper side inside a vehicle, FIG. 3 is an explanatory diagram illustrating the door 2 when viewed from the lower-front side of the vehicle, FIG. 4A is a cross sectional view illustrating a cross section in a vertical direction of a door at the position including the camera 7. FIG. 4B is an enlarged view of FIG. 4A showing the position provided with the camera.

As shown in FIGS. 2 to 4B, in the vehicle window glass lifting device 1 of the present embodiment, the camera 7 has an optical system 71 including at least one lens and an image pickup device 72 onto which a subject image is focused by the optical system 71, and the optical system 71 is arranged at a position corresponding to an opening 23*a* formed on an upper surface S of the door trim 23 so that an optical axis C of the optical system 71 passes through the opening 23*a*.

In other words, in the present embodiment, the camera 7 is provided on the upper surface S of the door trim 23. The upper surface S of the door trim 23 here is an outer surface of the door trim 23 at a top edge portion and is a surface which is visible from above in a vertical direction. The upper surface S of the door trim 23 may be inclined with respect to the vehicle width direction (horizontal direction). The door trim 23 is generally curved such that the upper surface S has the highest portion in the vicinity of the window glass 3, i.e., in the vicinity of an exit slot 21*a* allowing the window glass 3 to come out from the storage portion 21, and slopes down as a distance from the window glass 3 increases. Thus, the upper surface S of the door trim 23 is an outer surface of the door trim 23 (a portion corresponding to an inner circumferential surface on a lower side of the window frame 25) in the vicinity of the window glass 3 (the exit slot 21*a*).

The opening 23*a* is formed on the vehicle interior side with respect to the exit slot 21*a*, and the optical system 71 of the camera 7 is arranged so that the optical axis C is located on the vehicle interior side with respect to the exit slot 21*a*. Although the camera 7 in this example is arranged so that the optical axis C of the optical system 71 coincides with the vertical direction when viewed in the cross section in FIG. 4A, the optical axis C of the optical system 71 may be inclined with respect to the vertical direction in the front-back direction of the vehicle or in the vehicle width direction, and can be appropriately adjusted according to the installed position or desired imaging range of the camera 7.

In the present embodiment, the camera 7 is arranged in a hole 23*b* provided on the upper surface S of the door trim 23 at a front side position of the vehicle (at the front side position of the upper surface S of the door trim 23 on a side facing the window glass 3). Although the camera 7 provided on the upper surface S of the door trim 23 here has been described as an example, the position to provide the camera 7 is not limited thereto. The camera 7 may be provided on e.g. the inner circumferential surface of the frame portion 22 or an interior ceiling of the vehicle. The inner circumferential surface of the frame portion 22 here is a surface of the frame portion 22 facing the window glass 3 and is composed of a surface of the rear upright portion 22*a* on the front side of the vehicle, a surface of the front upright portion 22*b* on the rear side of the vehicle and a surface of the upper extended portion 22*c* on the lower side. In other words, the inner circumferential surface of the frame portion 22 is an outer surface of the frame portion 22 in the vicinity of the window glass 3. The installed position of the camera 7 will be described later.

The camera 7 has a columnar shape as a whole and has a flange 73 which is formed at a top end so as to protrude radially outward. The camera 7 is inserted into the hole 23*b* from above the door trim 23 and is fixed to the door trim 23 by arranging the flange 73 so as to be housed in a recess 23*c* formed at a circumferential edge of the hole 23*b* and engaging a locking pawl 23*d*, which is provided at a lower circumferential edge of the hole 23*b*, with a groove (not shown) provided on the camera 7. Although the top end face of the camera 7 is flush with the upper surface S of the door trim 23 in this example, the top end face of the camera 7 may protrude upward from the upper surface S of the door trim 23 or may be located below the upper surface S of the door trim 23. In addition, although the camera 7 in this example is arranged so that a portion of the optical system 71 is located above the opening 23*a*, the camera 7 may be arranged so that the optical system 71 is located below the opening 23*a*. In addition, the structure for fixing the camera 7 to the door trim 23 and the direction to insert the camera 7 are not specifically limited and can be appropriately changed.

The camera 7 is desirably configured so that the imaging range (a viewing angle) thereof covers the entire moving area of the window glass 3. In detail, in case that the window glass 3 is configured to be completely retracted, the viewing angle of the camera 7 desirably covers the range from the vertically upper portion to the lower end of the rear upright portion 22*a* on the rear side of the vehicle and from the vertically upper portion to the lower end of the front upright portion 22*b* on the front end of the vehicle. Meanwhile, in case that the window glass 3 is configured to not be completely retracted, the viewing angle of the camera 7 desirably covers the range from the vertically upper portion to an intersection formed between the rear upright portion 22*a* and the upper edge (upper rim) of the window glass 3 which is located at the lowest position, and the range on the front side of the vehicle from the vertically upper portion to an intersection formed between the front upright portion 22*b* and the upper edge (upper rim) of the window glass 3 which is located at the lowest position.

It is desirable to use a wide-angle lens as the optical system 71 of the camera 7 so that a foreign object can be detected in the range described above. The optical system 71 used in this example is formed by combining plural ultra-wide-angle lenses so as to have a viewing range of not less than 180°, or 190° taking into account the installation precision, in the front-back direction of the vehicle.

Meanwhile, to quickly detect the foreign object, the frame rate of the image pickup device 72 used is desirably as high as possible. In the present embodiment, a CMOS (Complementary MOS) image sensor is used as the image pickup device 72.

In the vehicle window glass lifting device 1 according to the present embodiment, the detection line 6 is provided with at least a first detection line 61 and a second detection line 62 provided to come close to the window glass 3 in the vehicle width direction with respect to the first detection line 61. The first detection line 61 and the second detection line 62 are provided along at least a part of the outer edge of the window glass 3 in a state that the door 2 and the window glass 3 are closed and provided on the vehicle interior side with respect to the window glass 3 respectively. In the present embodiment, both detection lines 61, 62 are provided along the entire frame portion 22 on the vehicle interior side at a distance from the window glass 3. As such, in the present embodiment, double detection lines 61, 62 are provided in the vehicle width direction.

The detection lines 61, 62 may be provided on either the door 2 or the vehicle body as long as it is provided along the window frame 25. For example, in a vehicle in which a distance D between the window glass 3 and an edge (an end face) of the frame portion 22 on the vehicle interior side (see FIG. 4A) is small, the second detection line 62 may be provided on the door 2 side and the first detection line 61 may be provided on the vehicle body side. The detection lines 61, 62 may not be respectively continuous, and can be respectively provided partially on the door 2 and partially on the vehicle body.

In the present embodiment, the both detection lines 61, 62 provided on the door 2 is described as an example. In this case, the both detection lines 61, 62 are provided on the inner circumferential surface of the entire frame portion 22, i.e., the inner surfaces of all the rear upright portion 22*a*, the front upright portion 22*b* and the upper extended portion 22*c*, on the vehicle interior side at a distance from the window glass 3.

The light source 8 is configured such that the entire both detection lines 61, 62 are exposed to radiation. Although four light sources 8 are used in this example to emit infrared radiation onto the both detection lines 61, 62 provided on the entire inner surface of the frame portion 22, the number of the light sources 8 is not limited thereto. In addition, although the light sources 8 in this example are arranged on the upper surface S of the door trim 23 in the vicinity of the camera 7, the positions of the light sources 8 are not limited thereto. For example, the light sources 8 may be arranged on the inner circumferential surface of the frame portion 22.

The both detection lines 61, 62 are formed so that brightness under infrared radiation is different from surrounding members. For example, when a metal (sheet metal) constituting the door 2 and a rubber member (waist) on the vehicle body are adjacent to each other in the state that the door 2 is closed, a boundary therebetween (i.e., a boundary between the door 2 and the vehicle body) can be used as the both detection lines 61, 62. Meanwhile, when the inner circumferential surface of the frame portion 22 is formed of a resin, a line formed by providing a recess on a portion of the resin so as to have a different infrared reflectance from the surroundings can be used as the both detection lines 61, 62. However, it is not limited thereto. The both detection lines 61, 62 may be formed by applying a highly infrared reflective paint to the inner surface of the frame portion 22, or may be an existing member of which brightness under infrared radiation is different from surroundings. The same applies to when the both detection lines 61, 62 are provided on the vehicle body.

In the present embodiment, the pinch prevention operation is also conducted when the blocked state (the second blocked state described below) is detected while the window glass 3 is moving down. This is to prevent a part of human body such as finger from being dragged into the exit slot 21*a* while the window glass 3 is moving down. A weather strip 30 having a lip seal 30*a* slidably in contact with the window glass 3 is provided around the exit slot 21*a* to prevent ingress of water, etc., into the storage portion 21 (an internal space of the door 2). When the window glass 3 is lowered, clothing or a part of human body such as finger may be dragged, together with the lip seal 30*a*, into the storage portion 21. In the present embodiment, it is possible to prevent such dragging and thereby to further improve safety. Here, an operation of moving down the window glass 3 is not included in the pinch prevention operation which is conducted when the blocked state is detected while the window glass 3 is moving down.

Figure 5:
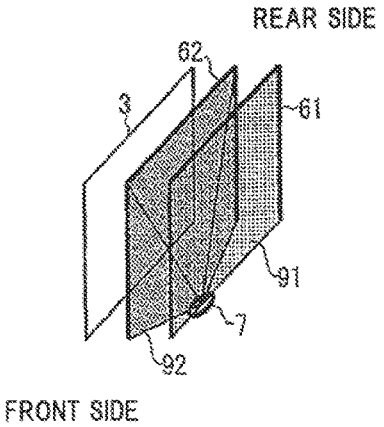
FIG. 5 is a schematic explanatory diagram illustrating an example of a detection surface.

A first detection surface 91 described hereinafter is a plane formed by connecting points between the optical system 71 of the camera 7 and the first detection line 61 at which the foreign object when located thereon causes the blocked state. In addition to, a second detection surface 92 described hereinafter is a plane formed by connecting points between the optical system 71 of the camera 7 and the second detection line 62 at which the foreign object when located thereon causes the blocked state. The first detection surface 91 and the second detection surface 92 formed in the present embodiment are shown in FIG. 5. As shown in FIG. 5, in the present embodiment, double detection surfaces 91, 92 are formed in the vehicle width direction.

The detection surfaces 91, 92 are substantially the same as a plane connecting the center of the optical system 71 (the center in the vehicle width direction, the height direction and the front-back direction of the vehicle) to the detection lines 61, 62 respectively, although depending on the specific configuration of the optical system 71. The detection surfaces 91, 92 do not need to be an entirely continuous plane. For example, when the detection lines 61, 62 are not continuous, the detection surfaces 91, 92 are composed of plural planes. Meanwhile, in case that the detection lines 61, 62 are composed of dots, lines are formed when connecting points between the optical system 71 of the camera 7 and the detection lines 61, 62 at which a foreign object when located thereon causes the blocked state, and such lines are also included as the detection surfaces 91, 92. When the detection surfaces 91, 92 are composed of plural planes or lines, a distance between adjacent planes or lines is desirably not more than at least a thickness of young child's finger (e.g., 4 mm) to ensure safety.

Next, control contents of the control unit 5 comprising the detection unit 51 and the pinching prevention unit 52 will be described.

In the present embodiment, the detection unit 51 is configured to detect at least a first blocked state in which the first detection line 61 is at least partially blocked by a foreign object, and a second blocked state in which the second detection line 62 is at least partially blocked by a foreign object.

In more detail, the detection unit 51 is provided with an image processing section 51*a* which processes an image captured by the camera 7 and extracts the both detection lines 61, 62, and a blocked state determination section 51*b* which determines, based on the image processed by the image processing section 51*a*, whether or not it is the first blocked state in which the first detection line 61 is at least partially blocked by a foreign object and whether or not it is the second blocked state in which the second detection line 62 is at least partially blocked by a foreign object.

A specific method of extracting the detection lines 61, 62 by the image processing section 51*a* is not specifically limited. For example, when an unnecessary portion is removed by trimming the image captured by the camera 7 and posterization process, binarization process or edge detection process is conducted, the detection lines 61, 62 with brightness different from surrounding members can be extracted.

The blocked state determination section 51*b* is configured such that, for example, images in a non-first blocked state and a non-second blocked state (which are images after being processed by the image processing section 51*a*) are preliminarily stored as initial state images, and whether or not the both detection lines 61, 62 are blocked by an foreign object is determined by comparing the initial state images to images output from the image processing section 51*a*. The blocked state determination section 51*b* is configured to, e.g., compare the initial state image to images output from the image processing section 51*a* and to determine it is the first blocked state and the second blocked state when differences of the edges of the extracted detection lines 61, 62 or differences of the areas of the detection lines 61, 62 exceed a preset foreign object determination threshold.

In addition, in the present embodiment, the pinching prevention unit 52 is configured such that the drive mechanism 4 conducts a control to reduce operational speed (moving speed) of the window glass 3 when the first blocked state is detected while the window glass 3 is moved and conducts the pinch prevention operation when the second blocked state is detected.

In such configuration, the operational speed of the window glass 3 can be reduced preliminary until the second blocked state is detected. The window glass 3 can be halted or reversed before an advancing foreign object comes into contact with the window glass 3 even when the second detection line 62 (the second detection surface 92) is provided closer to the window glass 3.

In other words, according to the present embodiment, the second detection line 92 (the second detection surface 92) can be provided closer to the window glass 3 while sufficient safety is ensured. As a result, the window glass 3 can be moved even when the passenger reclines to the door 2 (Meanwhile, the moving speed of the window glass 3 is reduced when the first blocked state is detected).

The both detection lines 61, 62 here are provided on the inner circumferential surface of the entire frame portion 22. Thus, the first blocked state is surely detected when the second blocked state is detected.

The pinch prevention operation that the drive mechanism 4 conducts when the pinching prevention unit 52 detects the second blocked state includes an operation of stopping movement of the window glass 3, an operation of lowering the window glass 3 to a safe position, an operation of warning an operator by sound or light from an alarm device installed inside the vehicle, and a combination thereof.

In the meantime, in view of more improving the convenience, it is desirable to provide the first detection surface 91 close to the window glass 3 preferably not only the second detection surface 92. To provide the first detection surface 91 close to the window glass 3, the time between when the first blocked state is detected and when the operational speed of the window glass 3 is reduced needs to be as short as possible, i.e., the operational speed of the window glass 3 needs to be reduced immediately.

In the present embodiment, the pinching prevention unit 52 is configured such that the operational speed of the window glass 3 is reduced by outputting instructions to halt the movement of the window glass 3 or lower the window glass 3 (an instruction to halt the window glass 3 while the window glass 3 is lowered) to the drive mechanism 4 when the first blocked state is detected while the window glass 3 is moved.

The pinching prevention unit 52 is configured to instruct the drive mechanism 4 to keep the instruction and halt the movement of the window glass 3 or lower the window glass 3 when the second blocked state is detected within the predetermined time after the first blocked state is detected, and to move the window glass 3 at low speed (it is referred to as low speed) that is lower than the operational speed in normal time (it is referred to as normal speed) when the second blocked state is not detected within the predetermined time after the first blocked state is detected.

"The predetermined time" here is set at time less than time that elapses from when the instruction such that the window glass 3 is halted or lowered to the drive mechanism 4 is output to when the window glass 3 is actually halted or lowered, more desirably, is set at time not less than time that elapse from when the instruction is output to the drive mechanism 4 such that the window glass 3 is halted or lowered to when the operational speed of the window glass 3 becomes predetermined low speed.

In other words, in the present embodiment, although the instructions to stop or lower the window glass 3 is output at timing when the first blocked state is detected, the window glass 3 is not halted or lowered at this timing. The window glass 3 is halted or lowered only when the second blocked state is detected.

This is because although the operational speed of the window glass 3 can be reduced by changing pulse width (duty ratio) output to the motor 41 since the motor 41 in the drive mechanism 4 is normally controlled by Pulse Width Modulation (PWM) control etc., the operational speed of the window glass 3 can be reduced more quickly by outputting the instruction to halt the window glass 3 and stopping power supply to the motor 41 than by changing the duty ratio. When the instruction to lower the window glass 3 is output, the operational speed of the window glass 3 can be reduced further quickly since the reverse voltage is applied to reverse the motor 41.

In the present embodiment, although the drive mechanism 4 is configured to output the instruction to halt the movement of the window glass 3 or lower the window glass 3 to the drive mechanism 4 (the instruction to halt the window glass 3 while the window glass 3 is lowered) such that an exist control content in the drive mechanism 4 is used without changing control content in the drive mechanism 4, the drive mechanism 4 can be configured to conduct a special control if the control content of the drive mechanism 4 can be changed. For example, the drive mechanism 4 may be configured such that the operational speed of the window glass 3 is reduced quickly by stopping power supply to the motor 41 or applying the reverse voltage to the motor 41.

In the present embodiment, although the operational speed of the window glass 3 is reduced by outputting the instruction to halt the movement of the window glass 3 or lower the window glass 3 (the instruction to halt the window glass 3 while the window glass 3 is lowered) to the drive mechanism 4 when the first blocked state is detected while the window glass 3 is moved, in this case, e.g., the motor 41 repeats switch on and off when the first blocked state repeats detected and non-detected by the rock of the passenger etc. Thus, the window glass 3 may instruct unnatural behavior depending on the structure of the drive mechanism 4. Therefore, the pinching prevention unit 52 is preferably configured to output the instruction such that the operational speed of the window glass 3 becomes the low speed to the drive mechanism 4 when the first blocked state is detected while the window glass 3 is moved in case that the unnatural behavior is remarkable. Furthermore, the unnatural behavior in the window glass 3 may be prevented by keeping the operational speed of the window glass 3 to the low speed until the predetermined time elapses from when the first blocked state is not detected in case that the first blocked state is not detected after the first blocked state is detected.

Next, the control when the window glass 3 begins to be moved will be described.

The control unit 5 is further provided with a low speed movement controller 53 to control the drive mechanism 4 to move the window glass 3 in the low speed when the first blocked state is detected and the second blocked state is not detected by the detection unit 51 after the movement of the window glass 3 is instructed by the switch 24 and before when the window glass 3 begins to be moved.

Providing the low speed movement controller 53 can begin the movement of the window glass 3 in the low speed when the first blocked state is detected. In such configuration, i.e., controlling the window glass 3 to be the low speed by detecting the first blocked state immediately after the window glass 3 begins to be moved in the normal speed is not occurred. The unnatural behavior of the window glass 3 is prevented. The low speed movement controller 53 is an embodiment of the low speed movement controller means in the present invention.

Moreover, the control unit 5 is further provided with an instruction cancellation unit 54 to cancel the instruction from the switch 24 when the second blocked state is detected by the detection unit 51 after the movement of the window glass 3 is instructed by the switch 24 and before when the window glass 3 begins to be moved.

Providing the instruction cancellation unit 54 further increases safety since the window glass 3 is never moved while the second blocked state is detected. The instruction cancellation unit 54 is an embodiment of instruction cancellation means in the present invention.

Next, the positions of the camera 7 and the detection lines 61, 62 will be considered.

In the present embodiment, positions of the camera 7 and the detection lines 61, 62 are determined such that the pinch prevention operation can be conducted (i.e., halting or reversing the window glass 3) before contact between the advancing foreign object and the window glass 3 in the entire moving area of the window glass 3.

The minimum distance (a distance from the inner surface of the window glass 3 in the vehicle width direction) at which the pinch prevention operation can be conducted before contact between the advancing foreign object and the window glass 3 is calculated by taking into account the anticipated advancing speed of the foreign object, the frame rate of the camera 7, the operating speed of the control unit 5 (time that elapses from when the image is captured to when it is judged that the foreign object enters) and the speed that the drive mechanism 4 stops the movement of the window glass 3 (the time that elapses before the window glass 3 stops). This minimum distance is referred to as a safety ensuring distance.

A distance d1 in the vehicle width direction between the first detection surface 91 and an inner surface of the window glass 3 is not less than the safety ensuring distance in the entire first detection surface 91 when the operational speed of the window glass 3 is the normal speed. Thus, the first detection line 61 is provided on a position where a distance in the vehicle width direction from the inner surface of the window glass 3 is not less than the safety ensuring distance when the operational speed of the window glass 3 is the normal speed. Also, the camera 7 is arranged at a position where a distance in the vehicle width direction from the inner surface of the window glass 3 to the center of the optical system 71 is not less than the safety ensuring distance when the operational speed of the window glass 3 is in the normal speed.

The first detection line 61 and the camera 7 provided at positions where the distances in the vehicle width direction from the inner circumferential surface of the window glass 3 are equal will be described. In such configuration, when a distance in the vehicle width direction between the detection line 61 and the inner circumferential surface of the window glass 3 is constant, the first detection surface 91 is provided in parallel to the window glass 3.

The second detection surface 92 is provided such that the minimum of the distance d2 in the vehicle width direction from the inner surface of the window glass 3 is not less than the safety ensuring distance when the operational speed of the window glass 3 is in the low speed. In such configuration, since the camera 7 is arranged at the same position with the first detection line 6 in the vehicle width direction, the second detection surface 92 comes most closely to the window glass 3 at a vicinity of the second detection line 62. Therefore, providing the second detection line 62 on a position where the distance in the vehicle width direction from the inner surface of the window glass 3 is not less than the safety ensuring distance when the operational speed of the window glass 3 is in the low speed allows the minimum of the distance d2 in the vehicle width direction from the inner surface of the window glass 3 to the second detection surface 92 to be not less than the safety ensuring distance when the operational speed of the window glass 3 is in the low speed.

Further, the distance between the first detection surface 91 and the second detection surface 92 is a distance that allows to reduce the operational speed of the window glass 3 from the normal speed to the low speed from when the foreign object advances through the first detection surface 91 (the first blocked state is detected) to when the foreign object advances to the second detection surface 92 by taking into account the advancing speed of an assumed foreign object etc.

Providing the positions of the camera 7 and the detection lines 61, 62 to satisfy above conditions allows to conduct the pinch prevention operation (i.e., halting or revering the window glass 3) before contact between the advancing foreign object and the window glass 3 in the entire moving area of the window glass 3.

Figure 6:
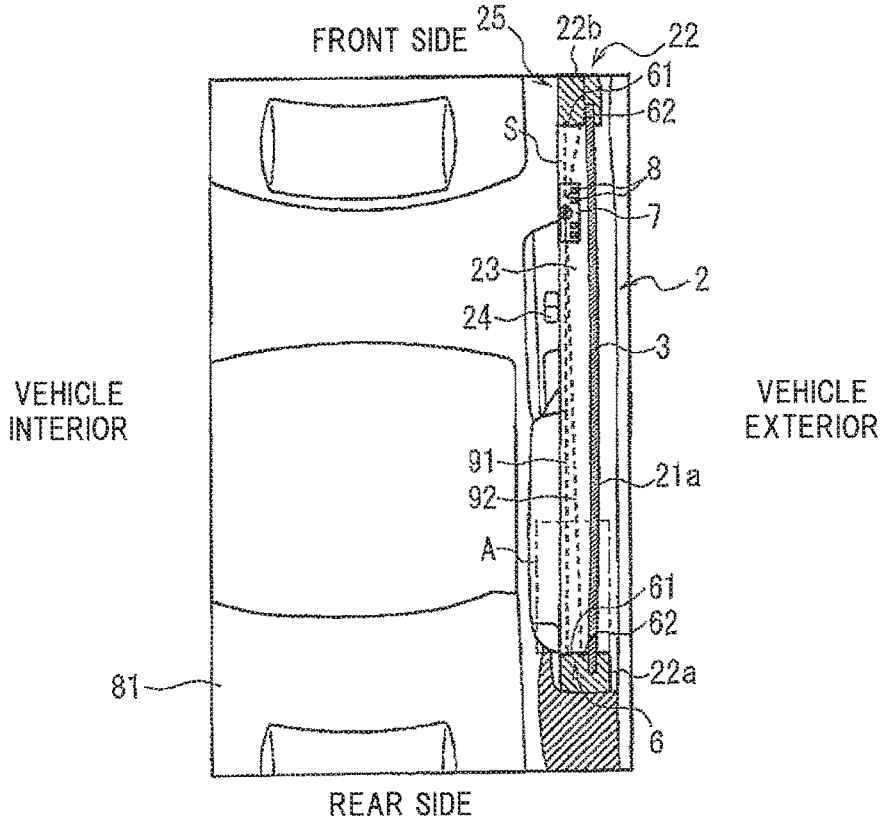
FIG. 6 is an explanatory diagram illustrating the detection surface of FIG. 5 viewed from the upper side.

Furthermore, in vehicle, a seat 81 is generally arranged at a position below the window glass 3 on the rear side as shown in FIG. 6, a part of the passenger's body such as shoulder or head, is likely to come close to the window glass 3 in a region A surrounded by the dot-and-dash line shown in FIG. 6, i.e., a rear region A in the window frame 25. Thus, the second detection surface 92 is desirably arranged to come close to the window glass 3 preferably in the rear region A in the window frame 25 such that the window glass 3 can be moved even when the passenger reclines to the door 2.

Figure 7:
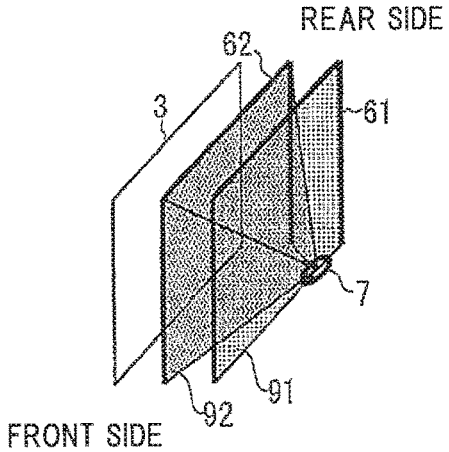
FIG. 7 is an explanatory diagram illustrating the position provided with the camera.

For example, as shown in FIG. 7, the second detection surface 92 is arranged at a position far from the window glass 3 in the rear area of vehicle when the camera 7 is arranged at a rear position of vehicle. It may be unable to move the window glass 3 when the passenger reclines to the door 2. Therefore, it is desirable to arrange the camera 7 at the front side of the window frame 25 preferably and arrange the camera 7 so as to come close to the window glass 3 preferably such that convenience in the rear area A in the above window frame 25 is improved.

The camera 7 is desirably arranged at, at least the front side in the front-back direction of the vehicle with respect to the center of the window glass 3 in the inner circumferential surface of the window frame 25 when the camera 7 is arranged at the vehicle interior side with respect to the second detection line 62 as with the present embodiment, depending on the position of the seat, the physical size of the passenger etc. In other words, the camera 7 is desirably arranged at the front side with respect to the center of the window glass 3 (the center in the front-back direction of the vehicle) in the upper surface S of the door trim 23 or the surface of the upper extended portion 22*c* on the lower side, or the rear side surface of the front upright portion 22*b*.

The relation between foreign object detection and the operational speed of the window glass when the foreign object advances while the window glass is lifted will be described by using FIGS. 8A and 8B. As an example, outputting the instruction to halt the window glass 3 to the drive mechanism 4 when the first blocked state is detected will be described. The vertical axis in FIGS. 8A and 8B shows the operational speed of the window glass 3 in a lifting direction.

Figure 8A:
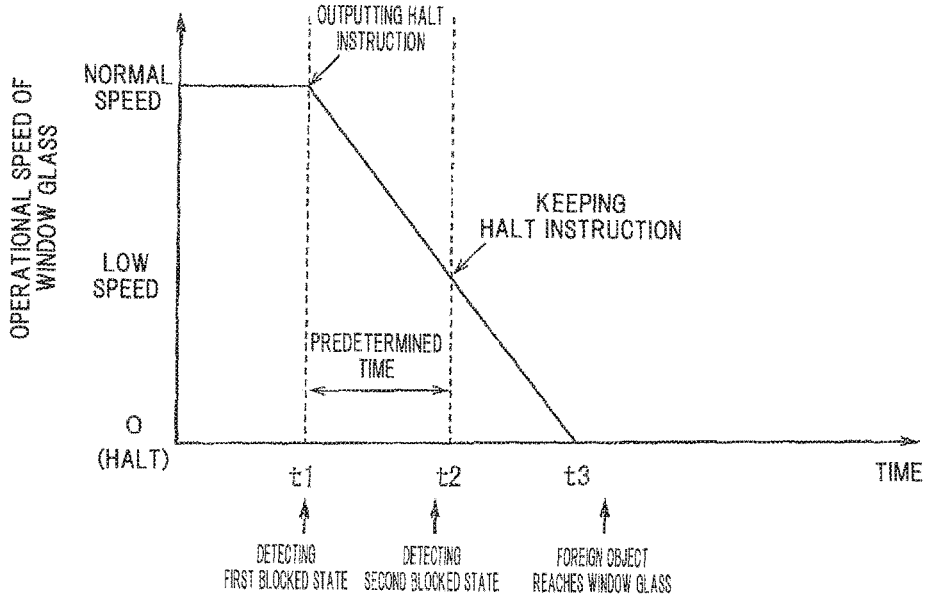
FIG. 8A is a timing diagram illustrating a relation between foreign object detection and operational speed of the window glass when the foreign object advances while the window glass is raised.

As shown in FIG. 8A, in the present embodiment, the operational speed of the window glass 3 is set at the normal speed in the state that the first blocked state and the second blocked state are not detected. When the first blocked state is detected at time t1, the instruction to halt the window glass 3 (halt instruction) is output and the operational speed of the window glass 3 is reduced.

Next, when the second blocked state is detected between the time t1 and time t2, i.e., the preset predetermined time elapses after the first blocked state is detected, the instruction to halt the window glass 3 (the halt instruction) is kept and the window glass 3 is halted before the foreign object reaches the window glass 3 (time t3).

Figure 8B:
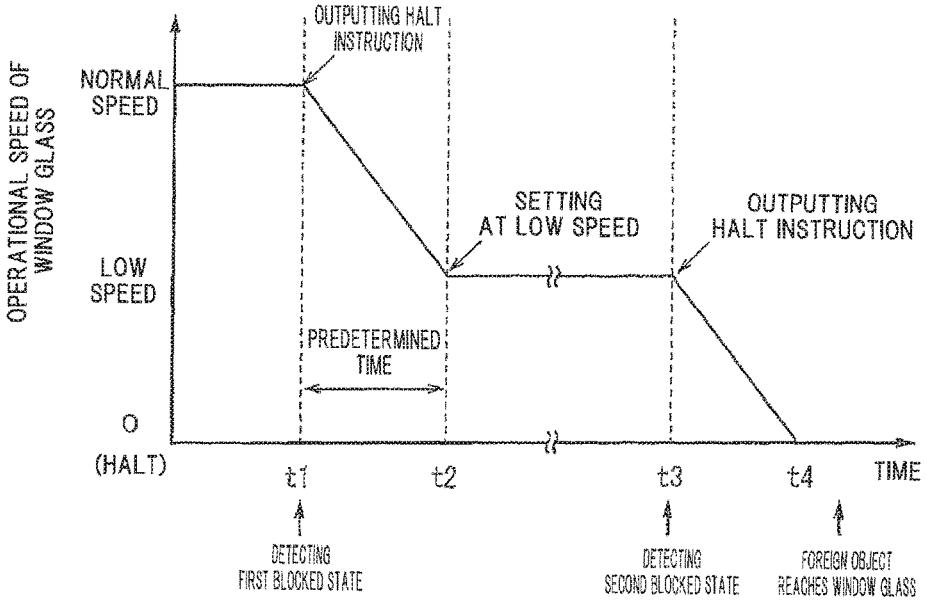
FIG. 8B is a timing diagram illustrating a relation between foreign object detection and the operational speed of the window glass when the foreign object advances while the window glass is raised.

Meanwhile, as shown in FIG. 8B, when the second blocked state is not detected between the time t1 and the time t2, i.e., during preset predetermined time elapses after the first blocked state is detected, the operational speed of the window glass 3 is set at the low speed at the time t2 and the movement of the window glass 3 is kept in low speed. Then, when the second blocked state is detected at the time t3, the pinch prevention operation (in this case, outputting the halt instruction) is conducted and the window glass 3 is halted before the foreign object reaches the window glass 3 (time t4).

Furthermore, in the present embodiment, although the positions of the camera 7 and the detection lines 61, 62 are determined such that the entire moving area of the window glass 3 becomes the non-contact region that allows to conduct the pinch prevention operation before the foreign object comes into contact with the window glass 3 even if the foreign object advances, it is not limited thereto. A part of lower area in the moving area of the window glass 3 may be the contact region.

Figure 9A:
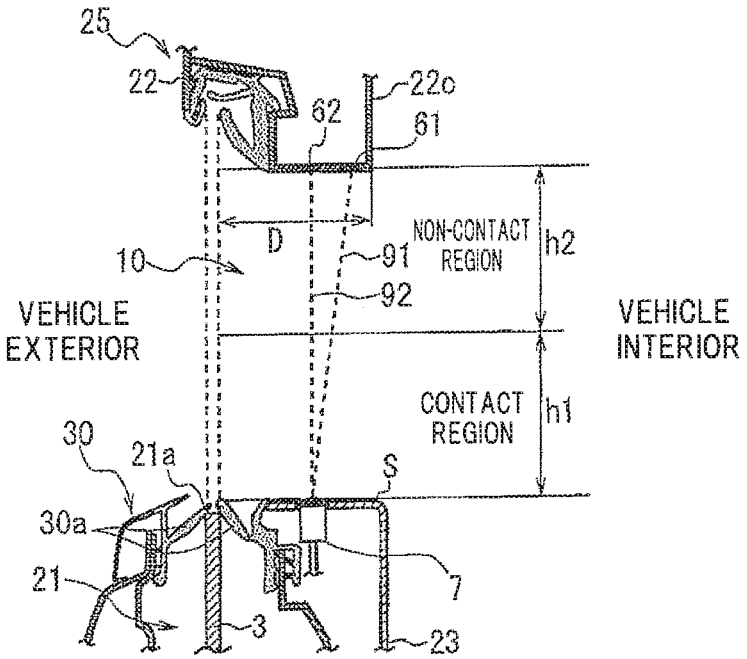
FIG. 9A is a cross sectional view illustrating a cross section in a vertical direction of a door at the position including a camera in a vehicle window glass lifting device according to a comparative example of the present invention.
Figure 9B:
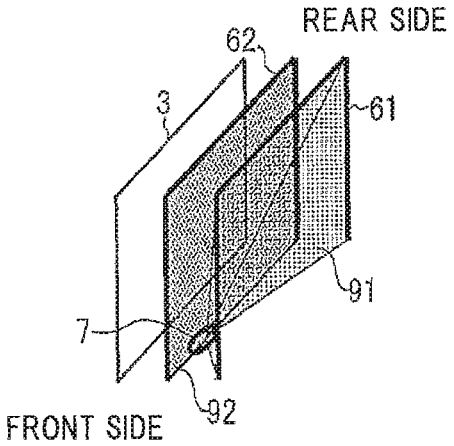
FIG. 9B is a schematic explanatory diagram illustrating a detection surface of FIG. 9A.

As shown in FIGS. 9A and 9B, when the camera 7 is arranged at a position where the distance from the window glass 3 in the vehicle width direction is less than the safety ensuring distance when the operational speed of the window glass 3 is set at the normal speed, the vicinity region of the camera 7 is the contact region where the foreign object may come into contact with the moving window glass 3 even if the pinch prevention operation is conducted after the foreign object is detected.

When the camera 7 is arranged on the upper surface S of the door trim 23 as shown in FIGS. 9A and 9B, the part of the lower area in the moving area of the window glass 3 becomes the contact region. In the lower area in the moving area of the window glass 3, although the foreign object may come into contact with the moving window glass 3, it is unlikely that the foreign object is pinched between the window glass 3 and the upper extended portion 22*c* since the pinch prevention operation is conducted just after the foreign object comes into contact with the window glass 3.

FIGS. 9A and 9B show the second detection line 62 and the camera 7 provided at positions where the distances in the vehicle width direction from the inner circumferential surface of the window glass 3 are equal. In such configuration, when a distance in the vehicle width direction between the detection line 62 and the inner circumferential surface of the window glass 3 is constant, the second detection surface 92 is provided in parallel to the window glass 3.

In this case, since the distance between the second detection surface 92 and the window glass 3 is constant in the entire moving area of the window glass 3, sufficient convenience can be ensured even if the camera 7 is arranged at the rear area of the window frame 25 (the area A described above). In other words, mount of freedom of an arrangement position of the camera 7 improves.

Meanwhile, since pinching by the window glass 3 is likely to occur at a closing end of the window frame 25, i.e., in an upper region of the moving area of the window glass 3, in such a case, the camera 7 is desirably arranged at, at least the lower side in the height direction with respect to the center of the window glass 3 in the inner circumferential surface of the window frame 25 such that the contact surface is preferably provided on the lower side.

It is desirable that the height h2 of the non-contact region be as large as possible without departing from convenience and the height h1 of the contact region as small as possible to ensure higher safety. In detail, judging from the pinching accidents actually occurred, serious accidents occur especially when a head of child of three years of age gets caught by the window glass 3. Considering that an average head height of three-year-old children is 191 mm, the height h2 of the non-contact region is desirably at least not less than 200 mm.

Figure 10:
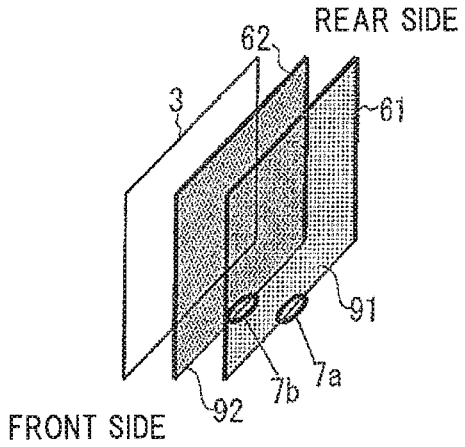
FIG. 10 is an explanatory diagram illustrating a vehicle window glass lifting device in another embodiment of the present invention.

Although using one camera 7 has been described, a plurality of cameras 7 can be applied as shown in FIG. 10.

In using the two cameras 7, it is configured such that one camera 7*a* (it is referred to as a first camera) captures the first detection line 61, the other camera 7*b* (it is referred to as a second camera) captures the second detection line 62, the first blocked state is detected by the detection unit 5 based on the image captured by the first camera 7*a*, and the second blocked state is detected by the detection unit 5 based on the image captured by the second camera 7*b*. In such a case, both detection surfaces 91, 92 can be arranged in parallel by arranging the first camera 7*a* at the same position in the vehicle width direction with the first detection line 61, and arranging the second camera 7*b* in the vehicle width direction at the same position with the second detection line 62. Safety and convenience can be ensured even when the cameras 7 are arranged at any position of the inner circumferential surface of the window frame 25.

Furthermore, using two cameras 7 allows to set layouts of both detection surfaces 91, 92 individually. The amounts of freedom in the layouts are improved. Meanwhile, the cameras 7 can be arranged at not only the inner circumferential surface of the window frame 25 but also any positions in the vehicle interior.

Next, a control flow of the vehicle window glass lifting device 1 will be described by using FIGS. 11 to 13.

Figure 11:
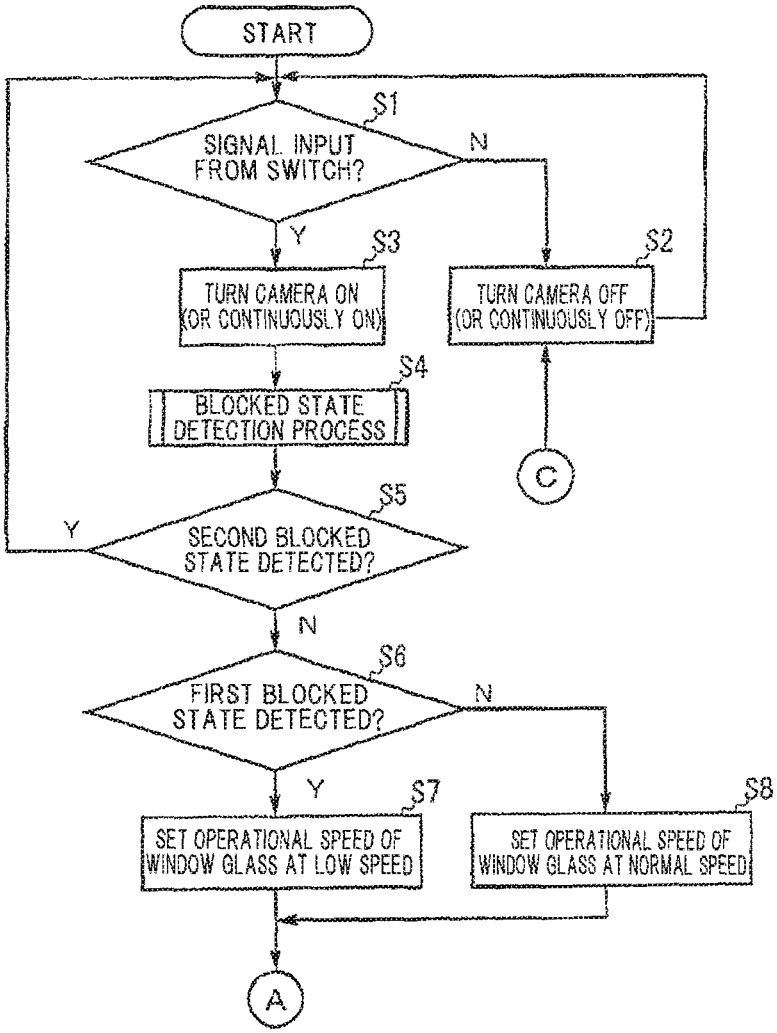
FIG. 11 is a flow chart showing a control flow of the vehicle window glass lifting device of the above embodiment and the comparative example.

As shown in FIG. 11, the vehicle window glass lifting device 1 is configured such that the control unit 5 firstly judges whether or not a signal is input from the switch 24 at Step S1. If judged as NO at Step S1, the control unit 5 controls the camera 7 to be turned off (or kept in the off-state) at Step S2 and the flow is allowed to return to Step S1. If the light sources 8 are turned on at this stage, the light sources 8 are also turned off at Step S2, though it is not shown in the drawing.

If judged as YES at Step S1, the control unit 5 controls the camera 7 to be turned on (or kept in the on-state) at Step S3 and the flow is allowed to proceed to Step S4. If the illumination intensity to capture an image by the camera 7 is not enough, the light sources 8 are turned on at Step S3, though it is not shown in the drawing.

At Step S4, the detection unit 51 (i.e., the image processing section 51*a* and the blocked state determination section 51*b*) conducts a processing of detecting the first blocked state and the second blocked state (i.e., a blocked state detection processing) based on the image captured by the camera 7. After that, at Step S5, the instruction cancellation unit 54 judges whether or not the second blocked state is detected by the detection unit 51.

If judged as YES at Step S5, the instruction cancellation unit 54 determines that there is a risk of being pinched by the window glass 3 and the flow is allowed to return to Step S without moving the window glass 3 (i.e., the signal from the switch 24 is cancelled).

If judged as NO at Step S5, at Step S6, the low speed movement controller 53 judges whether or not the first blocked state is detected by the blocked state detection processing at Step S4.

Figure 12:
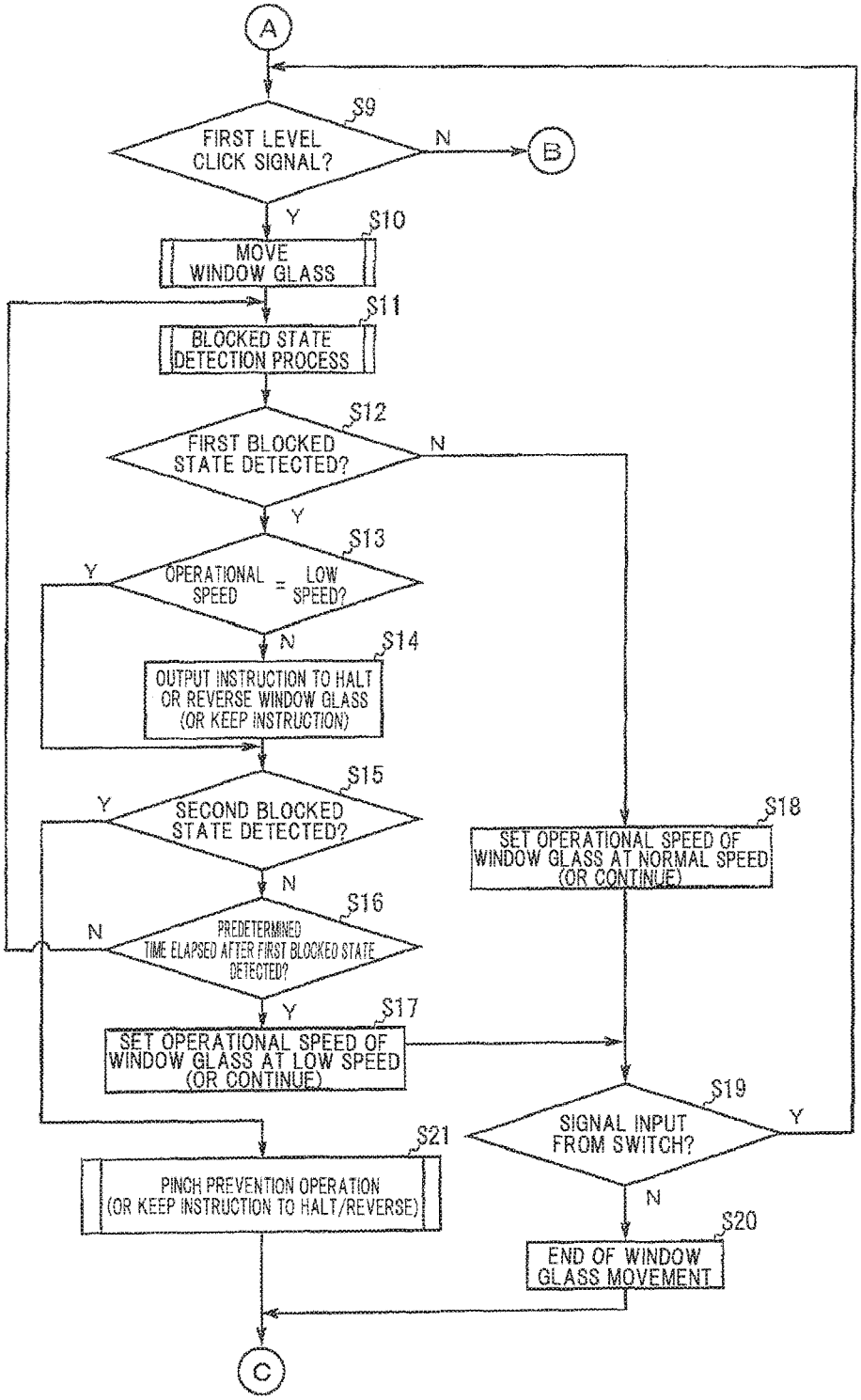
FIG. 12 is a flow chart showing a control flow of the vehicle window glass lifting device of the above embodiment and the comparative example.

If judged as YES at Step S6, the operational speed of the window glass 3 is set at the low speed at Step S7 and the flow is allowed to proceed to Step S9 in FIG. 12. If judged as NO at Step S6, the operational speed of the window glass 3 is set at the normal speed at Step S8 and the flow is allowed to proceed to Step S9 in FIG. 12.

As shown in FIG. 12, at Step S9, the control unit 5 judges whether or not the signal input from the switch 24 is a first level click signal (lowering side first level click signal or lifting side first level click signal).

Figure 13:
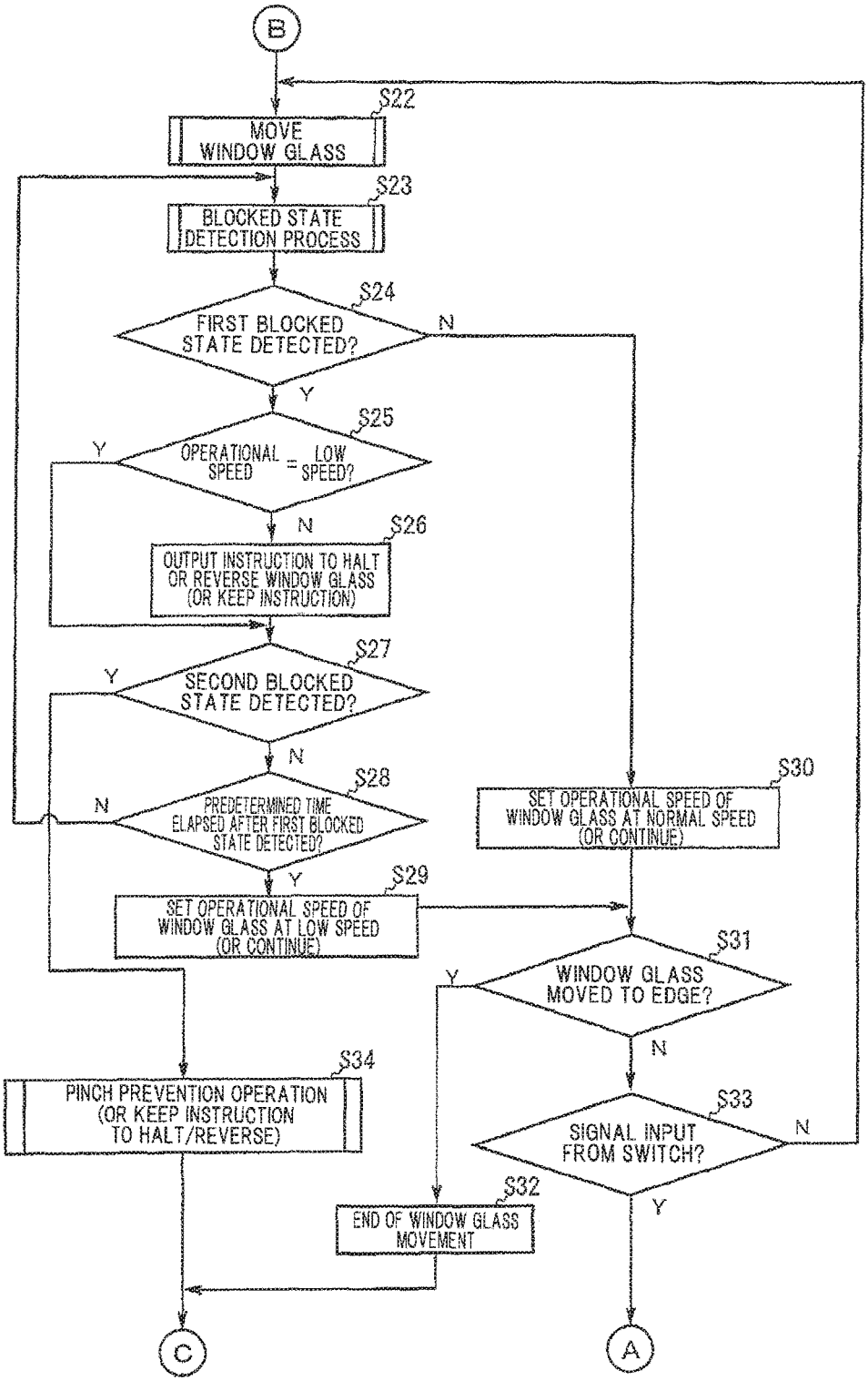
FIG. 13 is a flow chart showing a control flow of the vehicle window glass lifting device of the above embodiment and the comparative example.

If judged as NO at Step S9, i.e., a second level click signal (lowering side second level click signal or lifting side second level click signal) in input from the switch 24, the flow is allowed to proceed to Step S22 in FIG. 13. If judged as YES at Step S9, the control unit 5 instructs the drive mechanism 4 to control the movement of the window glass 3 at the set operational speed at Step S10.

After that, at Step S11, the detection unit 51 conducts a processing of detecting the first blocked state and the second blocked state (i.e., a blocked state detection processing) based on the image captured by the camera 7. After that, at Step S12, the pinching prevention unit 52 judges whether or not the first blocked state is detected by the detection unit 51.

If judged as NO at Step S12, since it is considered that the first blocked state is not detected and the foreign object fails to advance in the vicinity of the window glass 3, the operational speed of the window glass 3 is set at (or kept at) the normal speed at Step S18 and the flow is allowed to proceed to Step S19.

If judged as YES at Step S12, the pinching prevention unit 52 judges whether or not the operational speed of the window glass 3 is set at the low speed at Step S13. If judged as YES at Step S13, since the control to reduce the operational speed of the window glass 3 is not necessary, the flow is allowed to proceed to Step S15.

If judged as NO at Step S13, the pinching prevention unit 52 outputs instructions to halt or reverse the window glass 3 to the drive mechanism 4 so as to reduce the operational speed of the window glass 3 at Step S14 and the flow is allowed to proceed to Step S15. Meanwhile, at Step S14, the instruction to halt the window glass 3 is output when the window glass 3 is lowered.

At Step S15, the pinching prevention unit 52 judges whether or not the second blocked state is detected in the blocked state detection processing at Step S11. If judged as YES at Step S15, the pinch prevention operation is conducted (or the instruction at Step S14 is kept) at Step S21 and the flow is allowed to proceed to Step S2 in FIG. 11.

If judged as NO at Step S15, the pinching prevention unit 52 judges whether or not the predetermined time elapses after the first blocked state is detected at Step S16. If judged as NO at Step S16, since it is considered that the operational speed of the window glass 3 already becomes the low speed or it is in the way to reduce the speed of the window glass 3 by outputting the instructions to halt or reverse the window glass 3, the flow is allowed to return to Step S11, and the blocked state detection processing is maintained.

If judged as YES at Step S16, the operational speed of the window glass 3 is set at (or kept at) the low speed at Step S17 and the flow is allowed to proceed to Step S19.

At Step S19, the control unit 5 judges whether or not a signal is input from the switch 24. If judged as NO at Step S19, this means that an operation on the switch 24 is finished. Accordingly, the control unit 5 terminates the movement of the window glass 3 at Step S20 and the flow is allowed to return to Step S2 in FIG. 11. If judged as YES at Step S19, the flow is allowed to return to Step S9 and the window glass 3 is kept moving. As shown in FIG. 13, at Step S22, the control unit 5 instructs the drive mechanism 4 to control the movement of the window glass 3 at the predetermined operational speed.

After that, at Step S23, the detection unit 51 conducts a processing of detecting the first blocked state and the second blocked state (i.e., a blocked state detection processing) based on the image captured by the camera 7. After that, at Step S24, the pinching prevention unit 52 judges whether or not the first blocked state is detected by the detection unit 51.

If judged as NO at Step S24, since it is considered that the first blocked state is not detected and the foreign object does not enter in the vicinity of the window glass 3, the operational speed of the window glass 3 is set at (or kept at) the normal speed at Step S30 and the flow is allowed to proceed to Step S31.

If judged as YES at Step S24, the pinching prevention unit 52 judges whether or not the operational speed of the window glass 3 is set at the low speed at Step S25. If judged as YES at Step S25, since the control to reduce the operational speed of the window glass 3 is not necessary, the flow is allowed to proceed to Step S27.

If judged as NO at Step S25, the pinching prevention unit 52 outputs the instructions to halt or reverse the window glass 3 to the drive mechanism 4 so as to reduce the operational speed of the window glass 3 at Step S26 and the flow is allowed to proceed to Step S27. Meanwhile, when the window glass 3 is lowered, the instruction to halt the window glass 3 is output at Step S26.

At Step S27, the pinching prevention unit 52 judges whether or not the second blocked state is detected in the blocked state detection processing at Step S23. If judged as YES at Step S27, the pinch prevention operation is conducted (or the instruction at Step S26 is kept) at Step S34 and the flow is allowed to proceed to Step S2 in FIG. 11.

If judged as NO at Step S27, the pinching prevention unit 52 judges whether or not the predetermined time elapses after the first blocked state is detected at Step S28. If judged as NO at Step S28, since it is considered that the operational speed of the window glass 3 already becomes the low speed or it is in the way to reduce the speed of the window glass 3 by outputting the instructions to halt or reverse the window glass 3, the flow is allowed to return to Step S23, and the blocked state detection processing is maintained.

If judged as YES at Step S28, the operational speed of the window glass 3 is set at (or kept at) the low speed at Step S29 and the flow is allowed to proceed to Step S31.

At Step S31, the control unit 5 judges whether or not the window glass 3 is moved to an edge (to the top or bottom end). If judge as YES at Step S31, the control unit 5 terminates the movement of the window glass 3 at Step S32 and the flow is allowed to return to Step S2 in FIG. 11. Meanwhile, the positional information of the window glass 3 may be obtained by using a rotational pulse generated by a Hall IC incorporated in the motor 41, or using current ripple.

If judged as NO at Step S31, it is judged whether or not a new signal is input from the switch 24 (i.e., whether or not a new signal is input after the second-level click signal is input) at Step S33. If judged as YES at Step S33, the flow is allowed to return to Step S9 in FIG. 12. If judged as NO at Step S33, the flow is allowed to return to Step S22 and the window glass 3 is kept moving. That is, if the second-level click signal is input, the window glass 3 is kept moving until the second blocked state is detected, the window glass 3 is moved to an edge or a new signal is input from the switch 24.

Functions and Effects of the Embodiment

As described above, the vehicle window glass lifting device 1 according to the present embodiment is provided with the first detection line 61, and the second detection line 62 provided so as to come close to the window glass 3 in the vehicle width direction with respect to the first detection line 61, wherein the detection unit 51 is configured to detect the first blocked state in which the first detection line 61 is at least partially blocked by the foreign object and the second blocked state in which the second detection line 62 is at least partially blocked by the foreign object, wherein the pinching prevention unit 52 is configured to instruct the drive mechanism 4 to conduct the operation to reduce the operational speed of the window glass 3 when the first blocked state is detected while the window glass 3 is moved and to cause the drive mechanism 4 to conduct the pinch prevention operation when the second blocked state is detected.

In such configuration, sufficient safety can be ensured even if the second detection line 62 (the second detection surface 92) that is a reference line to conduct the pinch prevention operation is provided closer to the window glass 3 comparing to providing only one detection line (detection surface). As a result, e.g., even when the passenger reclines to the door 2, the window glass 3 can be moved at least the low speed when the second blocked state is not detected and it is unlikely to cause pinching by the window glass 3, hence, convenience is improved.

As such, according to the present embodiment, while keeping sufficient safety, it is possible to prevent a problem such that the pinch prevention operation is conducted despite no risk of getting pinched by the window glass 3 and the window glass 3 cannot be moved even when intended to move, hence, convenience is improved.

Summary of the Embodiment

Technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] A vehicle window glass lifting device (1), comprising:

a drive mechanism (4) arranged on a vehicle door (2) to vertically move a window glass (3);

a control unit (5) for controlling the drive mechanism (4); and a camera (7) for capturing an image of a detection line (6) provided on the vehicle interior side of the window glass (3), the detection line (6) being along at least a part of an outer edge of the window glass (3) in a state that the door (2) and the window glass (3) are closed, wherein the control unit (5) comprises a detection means (51) to detect a blocked state in which the detection line (6) captured as the image by the camera (7) is at least partially blocked by a foreign object, and a pinching prevention means (52) that causes the drive mechanism (4) to conduct a pinch prevention operation for preventing pinching by the window glass (3) when the blocked state is detected by the detection means (51) while the window glass (3) is moved by the drive mechanism (4), wherein the detection line (6) comprises at least a first detection line (61), and a second detection line (62) provided closer to the window glass (3) in a vehicle width direction than the first detection line (61), wherein the detection means (51) is configured to detect at least a first blocked state in which at least a part of the first detection line (61) is blocked by the foreign object and a second blocked state in which at least a part of the second detection line (62) is blocked by the foreign object, wherein the pinching prevention means (52) is configured to, while the window glass (3) is moved, cause the drive mechanism (4) to conduct a control to reduce an operational speed of the window glass (3) when the first blocked state is detected, and cause the drive mechanism (4) to conduct the pinch prevention operation when the second blocked state is detected.

[2] The vehicle window glass lifting device (1) according to [1], wherein the pinching prevention means (52) is configured to control the drive mechanism (4) to reduce the operational speed of the window glass (3) by outputting an instruction to halt a movement of the window glass (3) or lower the window glass (3) to the drive mechanism (4) if the first blocked state is detected while the window glass (3) is lifted, and by outputting an instruction to halt the movement of the window glass (3) to the drive mechanism (4) if the first blocked state is detected while the window glass (3) is lowered, to keep the instruction and halt the movement of the window glass (3) or lower the window glass (3) if the first blocked state is kept and the second blocked state is detected in a predetermined time after the first blocked state is detected, and to move the window glass (3) slower than an operational speed in normal times in which the first blocked state and the second blocked state are not detected, if the first blocked state is kept without detecting the second blocked state after the first blocked state is detected and the predetermined time later.

[3] The vehicle window glass lifting device (1) according to [1] or [2], wherein the control unit (5) further comprises a low speed movement control means (53) to control the drive mechanism (4) to move the window glass (3) slower than an operational speed in normal times in which the first blocked state and the second blocked state are not detected if the first blocked state is detected and the second blocked state is not detected by the detection means (51) after the movement of the window glass (3) is instructed and before the window glass (3) begins to be moved.

[4] The vehicle window glass lifting device (1) according to any one of [1] to [3], further comprising an instruction cancellation means (54) that cancels an instruction if the second blocked state is detected by the detection means (51) after the movement of the window glass (3) is instructed and before the window glass (3) begins to be moved.

[5] A vehicle, comprising the vehicle window glass lifting device (1) according to any one of [1] to [4]

Although the embodiment of the invention has been described, the invention according to claims is not to be limited to the above-mentioned embodiment. Further, please note that all combinations of the features described in the embodiment are not necessary to solve the problem of the invention.

The invention can be appropriately modified and implemented without departing from the gist thereof.

For example, although the two detection lines 6 providing the first detection line 61 and the second detection line 62 (providing the two detection surfaces 91, 92) has been described in the present embodiment, it is not limited thereto. For example, a number of the detection lines 6 (a number of the detection surfaces) may be not less than three and it may be configured such that the operational speed of the window glass 3 is steeply reduced according as the foreign object comes close from the vehicle interior side to the window glass 3 side.

Specifically, e.g., when the third detection line is provided at the vehicle interior side with respect to the first detection line 61, and a third blocked state in which the third detection line is blocked by the foreign object is detected in the above embodiment, the vehicle window glass lifting device 1 may be configured to reduce the operational speed of the window glass 3 to a first low speed lower than the normal speed, reduce the operational speed of the window glass 3 to the second low speed lower than the first low speed when the first blocked state is detected, and conduct the pinch prevention operation when the second blocked state is detected.

The invention can be appropriately modified and implemented without departing from the gist thereof. For example, although it is not mentioned in the embodiment, the vehicle window glass lifting device 1 may be provided with a safety device which monitors the rotational speed of the motor 41, determines that a foreign object is pinched by the window glass when the rotational speed of the motor 41 is reduced, and conducts various safety operations such as automatic lowering of the window glass 3 by reversing its movement direction.

In addition, although the invention is applied to a rear door 2 of vehicle in the embodiment, it is not limited thereto. The invention is also applicable to front doors of vehicle.

Furthermore, the invention is applied to the door 2 having the frame portion 22 in the embodiment, but is also applicable to doors of hardtop which do not have the frame portion 22 on the door 2 side.

INDUSTRIAL APPLICABILITY

The present invention can be applied to the vehicle window glass lifting device provided with a mechanism to prevent pinching by the window glass when the window glass is automatically moved.

REFERENCE SIGNS LIST

1 VEHICLE WINDOW GLASS LIFTING DEVICE
2 DOOR (VEHICLE DOOR)
3 WINDOW GLASS
4 DRIVE UNIT
5 CONTROL UNIT
6 DETECTION LINE
7 CAMERA
25 WINDOW FRAME
51 DETECTION UNIT (DETECTION MEANS)
52 PINCHING PREVENTION UNIT (PINCHING PREVENTION MEANS)
53 LOW SPEED MOVEMENT CONTROLLER (LOW SPEED MOVEMENT CONTROL MEANS)
54 INSTRUCTION CANCELLATION UNIT (INSTRUCTION CANCELLATION MEANS)
61 FIRST DETECTION LINE
62 SECOND DETECTION LINE
91 FIRST DETECTION SURFACE
92 SECOND DETECTION SURFACE

The invention claimed is:

1. A vehicle window glass lifting device, comprising:

a drive mechanism arranged on a vehicle door to vertically move a window glass;

a controller comprising hardware configured to control the drive mechanism; and at least one camera for capturing an image of at least one detection line provided on a vehicle interior side of the window glass, the at least one detection line being along at least a part of an outer edge of the window glass in a state that the door and the window glass are closed, wherein the at least one detection line comprises at least a first detection line and a second detection line provided closer to the window glass in a vehicle width direction than the first detection line, wherein the controller is configured to detect a blocked state in which at least a part of the at least one detection line captured as the image by the at least one camera is blocked by a foreign object, and the controller is configured to cause the drive mechanism to conduct a pinch prevention operation for preventing pinching by the window glass when the blocked state is detected while the window glass is moved by the drive mechanism, wherein the controller is further configured to detect at least a first blocked state in which at least a part of the first detection line is blocked by the foreign object and a second blocked state in which at least a part of the second detection line is blocked by the foreign object, and wherein the controller is further configured to, while the window glass is moved, cause the drive mechanism to conduct a control to reduce an operational speed of the window glass if the first blocked state is detected, and cause the drive mechanism to conduct the pinch prevention operation if the second blocked state is detected.

2. The vehicle window glass lifting device according to claim 1, wherein the controller is further configured to control the drive mechanism to reduce the operational speed of the window glass by outputting an instruction to halt a movement of the window glass or lower the window glass to the drive mechanism if the first blocked state is detected while the window glass is lifted, and by outputting an instruction to halt the movement of the window glass to the drive mechanism if the first blocked state is detected while the window glass is lowered, to keep the instruction and halt the movement of the window glass or lower the window glass if the first blocked state is kept and the second blocked state is detected in a predetermined time after the first blocked state is detected, and to move the window glass slower than an operational speed in normal times, normal times being in which the first blocked state and the second blocked state are not detected, or normal times being if the first blocked state is kept without detecting the second blocked state for a predetermined time after the first blocked state is detected.

3. The vehicle window glass lifting device according to claim 1, wherein the controller is further configured to control the drive mechanism to move the window glass slower than an operational speed in normal times, normal times being in which the first blocked state and the second blocked state are not detected, or normal times being if the first blocked state is detected and the second blocked state is not detected after the movement of the window glass is instructed and before the window glass begins to be moved.

4. The vehicle window glass lifting device according to claim 1, wherein the controller is further configured to cancel an instruction if the second blocked state is detected after the movement of the window glass is instructed and before the window glass begins to be moved.

5. The vehicle window glass lifting device according to claim 1, wherein the at least one camera comprises at least a first camera for capturing the first detection line and a second camera for capturing the second detection line, and wherein the controller is further configured to detect at least the first blocked state based on an image captured by the first camera and the second blocked state based on an image captured by the second camera.

6. A vehicle, comprising the vehicle window glass lifting device according to claim 1.

7. The vehicle window glass lifting device according to claim 2, wherein the controller is further configured to control the drive mechanism to move the window glass slower than the operational speed in the normal times, the normal times being in which the first blocked state and the second blocked state are not detected, or the normal times being if the first blocked state is detected and the second blocked state is not detected after the movement of the window glass is instructed and before the window glass begins to be moved.

8. The vehicle window glass lifting device according to claim 2, wherein the controller is further configured to cancel an instruction if the second blocked state is detected after the movement of the window glass is instructed and before the window glass begins to be moved.

9. The vehicle window glass lifting device according to claim 3, wherein the controller is further configured to cancel an instruction if the second blocked state is detected after the movement of the window glass is instructed and before the window glass begins to be moved.

10. The vehicle window glass lifting device according to claim 2, wherein the at least one camera comprises at least a first camera for capturing the first detection line and a second camera for capturing the second detection line, and wherein the controller is further configured to detect at least the first blocked state based on an image captured by the first camera and the second blocked state based on an image captured by the second camera.

11. The vehicle window glass lifting device according to claim 3, wherein the at least one camera comprises at least a first camera for capturing the first detection line and a second camera for capturing the second detection line, and wherein the controller is further configured to detect at least the first blocked state based on an image captured by the first camera and the second blocked state based on an image captured by the second camera.

12. The vehicle window glass lifting device according to claim 4, wherein the at least one camera comprises at least a first camera for capturing the first detection line and a second camera for capturing the second detection line, and wherein the controller is further configured to detect at least the first blocked state based on an image captured by the first camera and the second blocked state based on an image captured by the second camera.

13. A vehicle, comprising the vehicle window glass lifting device according to claim 2.

14. A vehicle, comprising the vehicle window glass lifting device according to claim 3.

15. A vehicle, comprising the vehicle window glass lifting device according to claim 4.

16. A vehicle, comprising the vehicle window glass lifting device according to claim 5.

* * * * *